US006522854B2

(12) United States Patent
Nishiuwatoko

(10) Patent No.: US 6,522,854 B2
(45) Date of Patent: Feb. 18, 2003

(54) DEVELOPING APPARATUS PREVENTING ROTATION BETWEEN MAGNET AND BEARING

(75) Inventor: Tsutomu Nishiuwatoko, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/733,964

(22) Filed: Dec. 12, 2000

(65) Prior Publication Data

US 2001/0021328 A1 Sep. 13, 2001

(30) Foreign Application Priority Data

Dec. 14, 1999 (JP) ..... 11-354073

(51) Int. Cl.[7] ..... G03G 15/09
(52) U.S. Cl. ..... 399/267; 399/277
(58) Field of Search ..... 399/267, 276, 399/277, 279, 111, 116, 117, 159, 90

(56) References Cited

U.S. PATENT DOCUMENTS 3,981,271 A * 9/1976 Okada et al. ..... 399/277 X
5,583,473 A * 12/1996 Yamashita ..... 399/267 X
5,682,587 A * 10/1997 Higeta et al. ..... 399/277
5,758,242 A * 5/1998 Malespin et al. ..... 399/277
5,870,655 A * 2/1999 Nishiuwatoko et al. ..... 399/111
5,946,535 A * 8/1999 Aoki ..... 399/277
6,144,819 A 11/2000 Nishiuwatoko ..... 399/90

FOREIGN PATENT DOCUMENTS

JP 06-289719 * 10/1994

* cited by examiner

*Primary Examiner*—Sophia S. Chen
(74) *Attorney, Agent, or Firm*—Fitzpatrick, Cella, Harper & Scinto

(57) ABSTRACT

The present invention provides a developing apparatus which has a developer carrying member opposed to an image bearing member for bearing a latent image and adapted to carry magnetic developer, a magnet provided within the developer carrying member and having one end secured to a frame of the apparatus, and a bearing fitted on other end of the magnet and adapted to rotatably support the developer carrying member, wherein a fitting portion between the magnet and the bearing has a non-circular shape.

4 Claims, 9 Drawing Sheets

DEVELOPING APPARATUS PREVENTING ROTATION BETWEEN MAGNET AND BEARING

BACKGROUND OF THE INVENTION

1. Field of the Invention

The present invention relates to a developing apparatus used with an image forming apparatus of electrophotographic or electrostatic type such as a copying machine, a printer and the like and adapted to develop a latent image an an image bearing member.

2. Related Background Art

In conventional image forming apparatuses of electrophotographic type, a latent image is formed on a photosensitive drum as an image bearing member by selectively exposing a surface of the photosensitive drum uniformly charged by a charging apparatus by means of an exposing apparatus, and the latent image is visualized with toner as a developer by a developing apparatus to form a toner image, and the toner image is transferred onto a recording medium such as a paper or an OHP sheet, and the toner image is fixed to the recording material with heat and pressure, thereby obtaining an image.

On the other hand, after the toner image is transferred, residual toner remaining on the photosensitive drum is removed by a cleaning apparatus, for preparing for next image formation starting from charging.

Incidentally, in such image forming apparatuses, when the apparatus is used for a long term, replenishing of new toner to the developing apparatus and adjustment, cleaning and exchanging of various process parts including the photosensitive drum are required. It was practically difficult for the users other than experts to perform such maintenance. Thus, in order to solve this problem, there has been proposed a process cartridge in which a toner and process means such as a photosensitive drum, a developing apparatus, charging apparatus and cleaning apparatus are integrally incorporated as a cartridge unit which can detachably be mounted to an image forming apparatus, thereby enhancing maintenance ability, and such a process cartridge is put to practical use.

The developing apparatus included in such a process cartridge comprises a developing apparatus frame for containing toner as developer, a developer carrying member, and a developing blade as a developer regulating member.

The developer carrying member comprises a developing roller as a hollow cylindrical member in which flanges as shaft members are attached to both ends of a hollow cylinder made of conductive and nonmagnetic material such as aluminum, and a magnet roller held within the developing roller. A gear for transmitting a rotational driving force to the developing roller is secured to one of the flanges of the developing roller. The developer carrying member is arranged so that an outer peripheral surface of the developer roller cylinder is opposed to an outer peripheral surface of the photosensitive drum with a predetermined gap (preferably, 0.2 to 0.5 mm) therebetween.

The developing blade has one end secured to the developing apparatus frame and the other or free end urged against the outer peripheral surface of the developing roller cylinder.

The interior of the developing apparatus frame is divided into a toner chamber and a developer supplying chamber, and the toner as developer is contained in the toner chamber, and the developer carrying member and the developing blade are contained in the developer supplying chamber.

The toner in the toner chamber is carried from the toner chamber to the developer supplying chamber by its own weight or by conveying means and is attracted to the vicinity of the developer carrying member by a magnetic force of the magnet roller. During image formation, the developing roller is rotated by the driving force transmitted to the flange gear at its one end. The toner attracted around the outer peripheral surface of the developing roller is carried toward the developing blade as the developing roller is rotated, and regulation of a developer layer thickness and application of tribo-electricity are effected by the developing blade while the toner is being carried toward the photosensitive drum.

As the developer carrying members, there have been proposed a developer carrying member in which, as shown in FIG. 7, magnet shafts (first magnet shaft 272 and a second magnet shaft 273) as shaft portions provided on both ends of a magnetizing portion 271 as a main part of a magnet roller 270 as a magnetic field generating member extend through holes formed in flanges 262, 263 as shaft members of a developing roller 260 as a hollow cylindrical member and are supported by a developing apparatus frame 246, and a developer carrying member in which, as shown in FIGS. 8 and 9, one (first magnet shaft 172) of magnet shafts as shaft portions is held within an inner diameter portion of one (first flange 162) of flanges as shaft members and only the other magnet shaft (second magnet shaft 173) extends through a through hole formed in the other flange (second flange 163) and is held by a developing apparatus frame 146,and these developer carrying members are put to practical use.

Next, the developer carrying members will be fully described.

First of all, the cylinder-shaped developer carrying member 261 in which the shafts at both ends of the magnet roller are held by the developing apparatus frame 246 will be explained with reference to FIG. 7.

As mentioned above, the developing roller 260 as the hollow cylindrical member which forms a main part of the developer carrying member 261 includes a cylinder portion 261 formed from aluminum, and the first and second flanges 262, 263 as the shaft members attached to both ends of the cylinder portion 261 and is rotatably held by the first and second flanges 262, 263.

A gear 264 as drive transmitting means is secured to the first flange 262.

The magnet roller 270 as the magnetic field generating means disposed within the developing roller 260 has the magnetizing portion 271 having a plurality of magnetic poles, and the first and second magnet shafts 272, 273 as the shaft portions provided on both ends of the magnetizing portion.

The first and second magnet shafts 272, 273 extend through the first and second flanges 262, 263 of the developing roller 260, and at least one of the magnet shafts is provided at its tip end area with D-cut shaped rotation preventing means so that the magnet roller 270 is always held at a predetermined angle in a circumferential direction.

If the first and second flanges 262, 263 of the developing roller 260 are misaligned with the cylinder portion 261 in an axial direction, since the developing roller 260 is shifted by an amount corresponding to the misalignment amount during one revolution thereof, an abutting condition between the developing roller and the developing blade 242 will be changed, with the result that uniformity of the image cannot be maintained. On the other hand, since a temperature within the main body of the apparatus is increased as the apparatus is operated, operating environmental humidity of the developing apparatus is not constant. Thus, in order to maintain the concentricity between the first and second flanges 262, 263 and the cylinder portion 261 with high accuracy regardless of the environmental temperature, a technique in which at least one of the first and second flanges 262, 263 is formed from aluminum similar to the cylinder portion 261 and the aluminum flange is press-fitted in the cylinder portion 261 and the first and second flanges 262, 263 due to difference in thermal expansion caused by the temperature increase is prevented. Incidentally, in this case, the gear 264 is generally secured to the aluminum flange.

Next, the cylinder-shaped developer carrying member 161 in which one (first magnet shaft 172) of the magnet roller 170 is held within the inner diameter portion of one (first flange 162) of flanges and the second magnet shaft 173 is held by the developing apparatus frame 146 will be explained with reference to FIG. 8.

Also in the developing roller 160 shown in FIGS. 8 and 9, similar to the developing roller 260 shown in FIG. 8, it is preferable that one (first flange 162 in the illustrated example) of the flanges is formed from aluminium. On the other hand, although material obtained by adding ferrite to nylon has widely been used for making the magnet roller 170, since a sliding property of such material with respect to metal is not good, a magnet supporting member 180 as a bearing member formed from material (for example, resin such as polyacetal) which has a good sliding property is used between the magnet shaft (first magnet shaft 172 in the illustrated example) and the first flange 162.

Incidentally, since there is difference in coefficient of linear expansion between the aluminum forming the first flange 162 and the resin forming the magnet supporting member 180 and the resin (nylon) forming the magnet roller 170, a gap is previously set between the first flange 162 and the magnet supporting member 180 or between the magnet supporting member 180 and the magnet shaft 172 in consideration of such coefficient of linear expansion.

By the way, as image forming apparatuses have recently been progressed increasingly, the entire image forming apparatus (main body of the apparatus) and the process cartridge are requested to be made more compact. In order to realize this, the diameter of the developing roller must be reduced. Further, in order to make the process cartridge compact, the arrangement, as shown in FIGS. 8 and 9, in which one of the magnet shafts of the magnet roller is held by the flange portion (first flange) of the developing roller is inevitable.

However, in the developer carrying member 161, if the magnet roller 170 is vibrated during the image formation, since the magnetic force (magnetic flux density) of the magnet roller 170 acting on a developing area where the developing roller 160 is opposed to the photosensitive drum is changed, the magnetic force for holding the toner on the surface of the developing roller 160 in the developing area is also changed, with the result that the image density is changed. For example, it was experimentally found that in case of a magnet roller 170 having four magnetic poles, a relationship between a distance d from the surface of the magnet roller 170 to the surface of the developing roller 160 and a magnetic force f on the surface of the developing roller 160 is as shown in FIG. 10 and a relationship between a magnetic force f acting on the surface of the developing roller 160 and image density z at predetermined print ratio (half toner) is as shown in FIG. 11.

Thus, the following factors relating to the positional accuracy of the magnet roller 170 affect an influence upon the uniformity of the image density:

(1) the deviation of the concentricity between the inner diameter of the magnet supporting member and the outer diameter of the magnet supporting member; and (2) the deviation of the concentricity between the outer diameter of the developing roller and the inner diameter of the flange portion.

SUMMARY OF THE INVENTION

An object of the present invention is to provide a developing apparatus in which an axial direction of a developer carrying member is reduced.

Another object of the present invention is to provide a developing apparatus in which positional accuracy of a magnet roller is high.

A further object of the present invention is to provide a developing apparatus comprising a developer carrying member opposed to an image bearing member for bearing a latent image and adapted to carry magnetic developer, a magnet provided within the developer carrying member and having one end secured to a frame of the apparatus, and a bearing fitted on other end of the magnet and adapted to rotatably support the developer carrying member, wherein a fitted portion between the magnet and the bearing has a noncircular shape.

The other objects and features of the present invention will be apparent from the following detailed explanation of the invention referring to the accompanying drawings.

DESCRIPTION OF THE PREFERRED EMBODIMENTS

The present invention will now be explained in connection with embodiments thereof with reference to the accompanying drawings.

Figure 1:
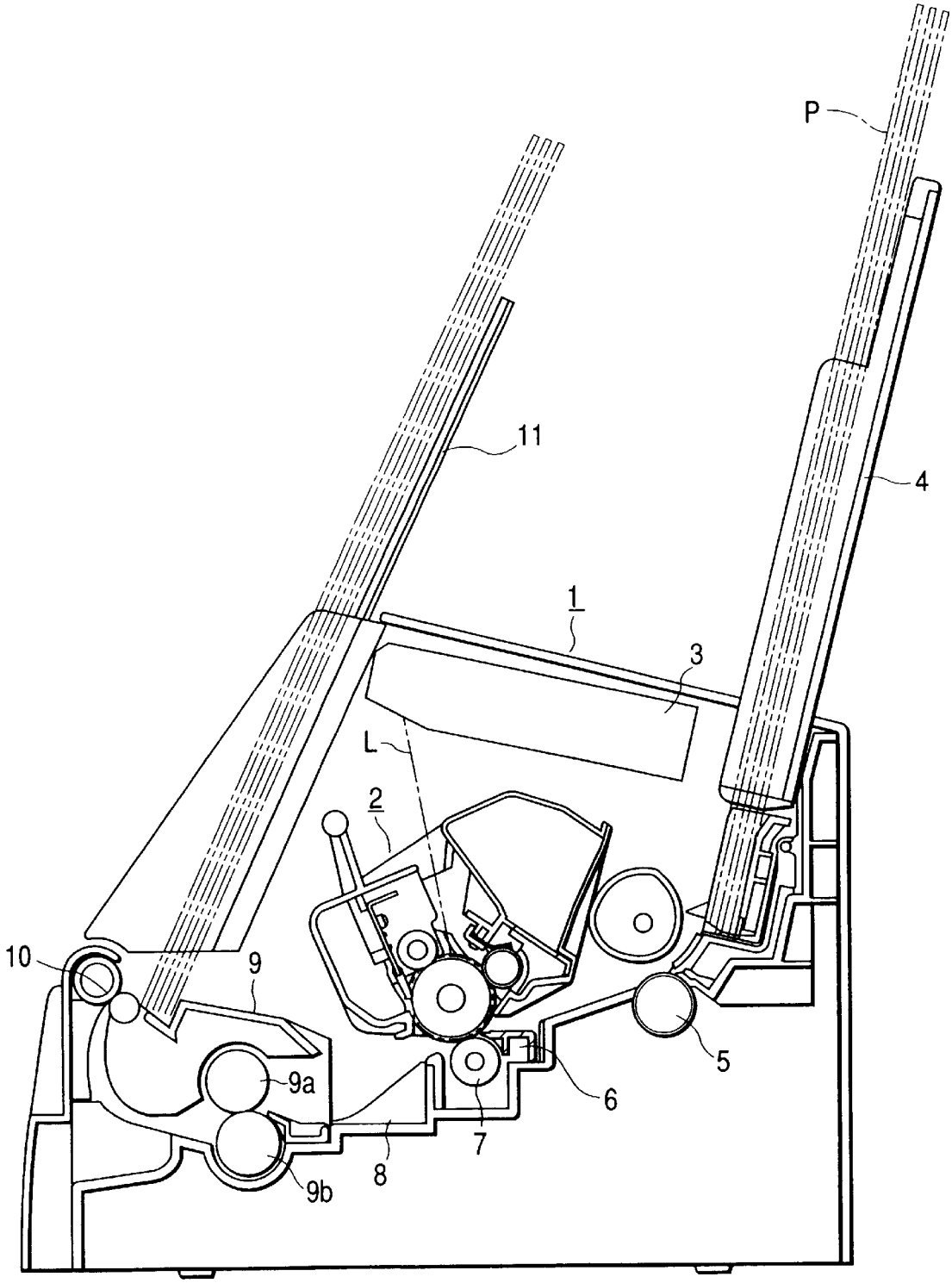
FIG. 1 is a sectional view showing a schematic construction of an image forming apparatus according to an embodiment of the present invention.

FIG. 1 is a sectional view showing a schematic construction of an image forming apparatus 1 which is a laser printer of electrophotographic type as an example of an image forming apparatus according to an embodiment of the present invention.

The image forming apparatus 1 includes a process cartridge 2 which is detachably attachable to a main body of the image forming apparatus.

The image forming apparatus 1 also includes a laser scanner unit 3 as an exposing apparatus which is installed above the process cartridge 2 when the process cartridge 2 is mounted to the main body of the image forming apparatus, and a sheet tray 4 disposed at that side (right side in FIG. 1) of the process cartridge 2 and adapted to contain sheet materials P as recording media on which images are to be formed. Further, within the main body of the image forming apparatus 1, along a conveying direction of the sheet material P, there are provided a sheet feeding roller 5, a transfer guide 6, a transfer charging roller 7, a conveying guide 8, a fixing apparatus 9, a pair of discharge rollers 10, and a sheet discharge tray 11 disposed on a resin frame la of the main body of the apparatus.

Figure 2:
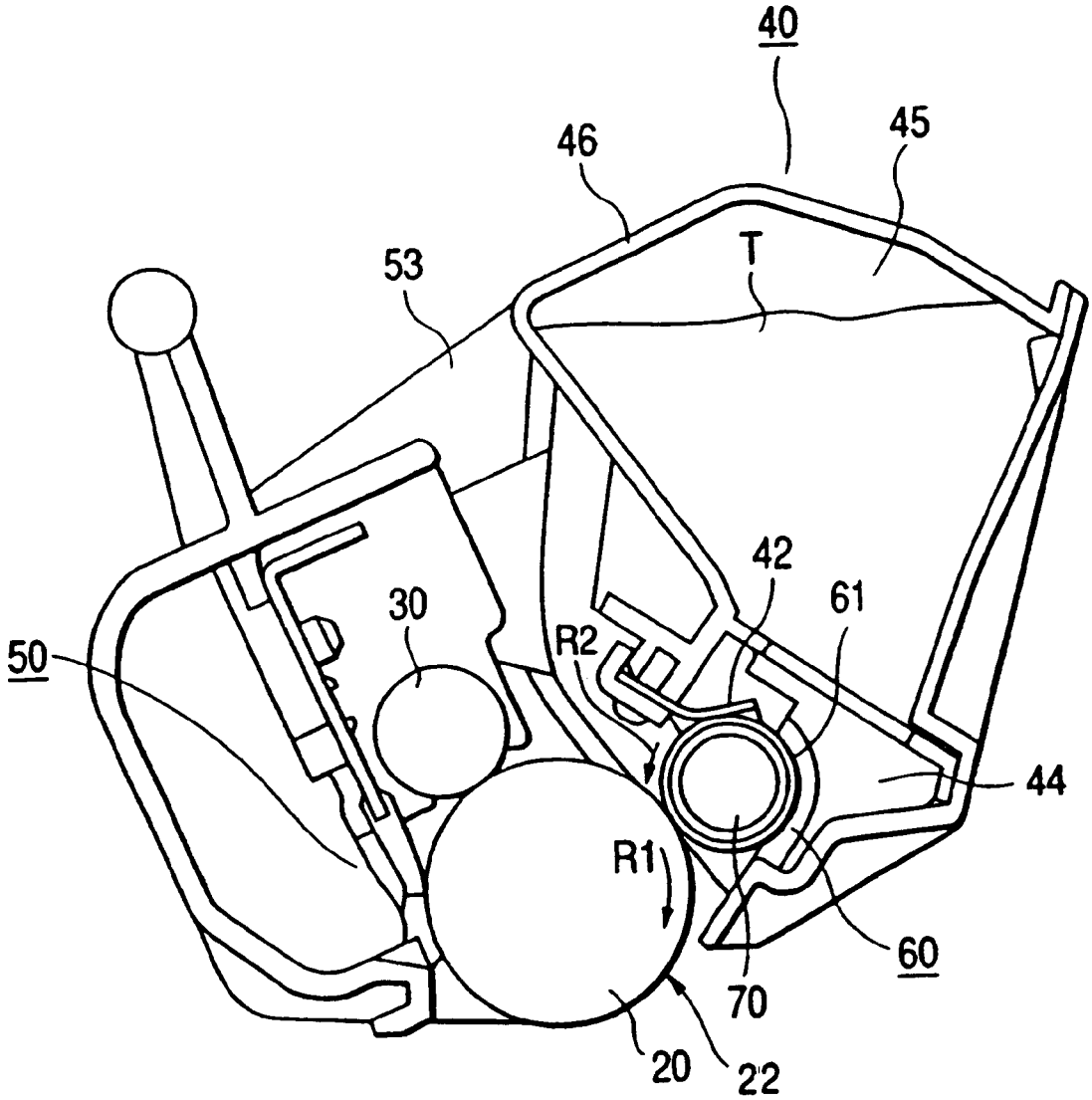
FIG. 2 is a sectional view showing a schematic construction of a process cartridge used with the image forming apparatus of FIG. 1.

As shown in FIG. 2, the process cartridge 2 integrally includes four process devices, i.e., a photosensitive drum 20 as a latent image bearing member, a charging apparatus 30, a developing apparatus 40 and a cleaning apparatus 50.

Incidentally, the process cartridge 2 may include at least photosensitive drum 20 and developing apparatus 40.

Next, an outline of the image formation will be described.

In the image forming apparatus 1, in response to a print start signal, the photosensitive drum 20 is rotated at a predetermined peripheral speed (process speed) in a direction shown by the arrow R1. The charging apparatus 30 to which bias is applied is contacted with an outer peripheral surface of the photosensitive drum 20 so that the outer peripheral surface of the photosensitive drum 20 is uniformly charged by the charging apparatus 30.

A laser beam L modulated in correspondence to a time-lapse electric digital signal corresponding to target image information is emitted from the laser scanner unit 3, and a photosensitive layer 22 constituting the outer peripheral surface of the photosensitive drum 20 is exposed by the laser beam entering into the process cartridge 2 through an exposure window 53 formed on an upper surface of the process cartridge 2. As a result, an electrostatic latent image corresponding to the target image information is formed on the photosensitive layer 22 of the photosensitive drum 20. The electrostatic latent image developed by the developing apparatus 40 with toner T as developer to form a toner image.

On the other hand, the sheet material P is fed out from the sheet tray 4 by the sheet feeding roller in synchronism with the emission of the laser beam L, and the fed sheet material is supplied to a transfer position between the photosensitive drum 20 and the transfer charging roller 7 through the transfer guide 6 at a predetermined timing. In the transfer position, the tone image is transferred successively from the photosensitive drum 20 onto the sheet material P.

The sheet material P to which the toner image was transferred is separated from the photosensitive drum 20 and then is sent, along the conveying guide 8, to the fixing apparatus 9, where, while the sheet material is being passed through a nip portion between a fixing roller 9*a* and a pressurizing roller 9*b*, the toner image is fixed to the sheet material P with heat and pressure. The sheet material P to which the toner image was fixed is conveyed to the pair of discharge rollers 10 by which the sheet is discharged onto the sheet discharge tray 11.

On the other hand, after the transferring, residual toner remaining on the outer peripheral surface of the photosensitive drum 20 is removed by the cleaning apparatus 50 for preparing for next image formation starting from the charging.

Figure 3:
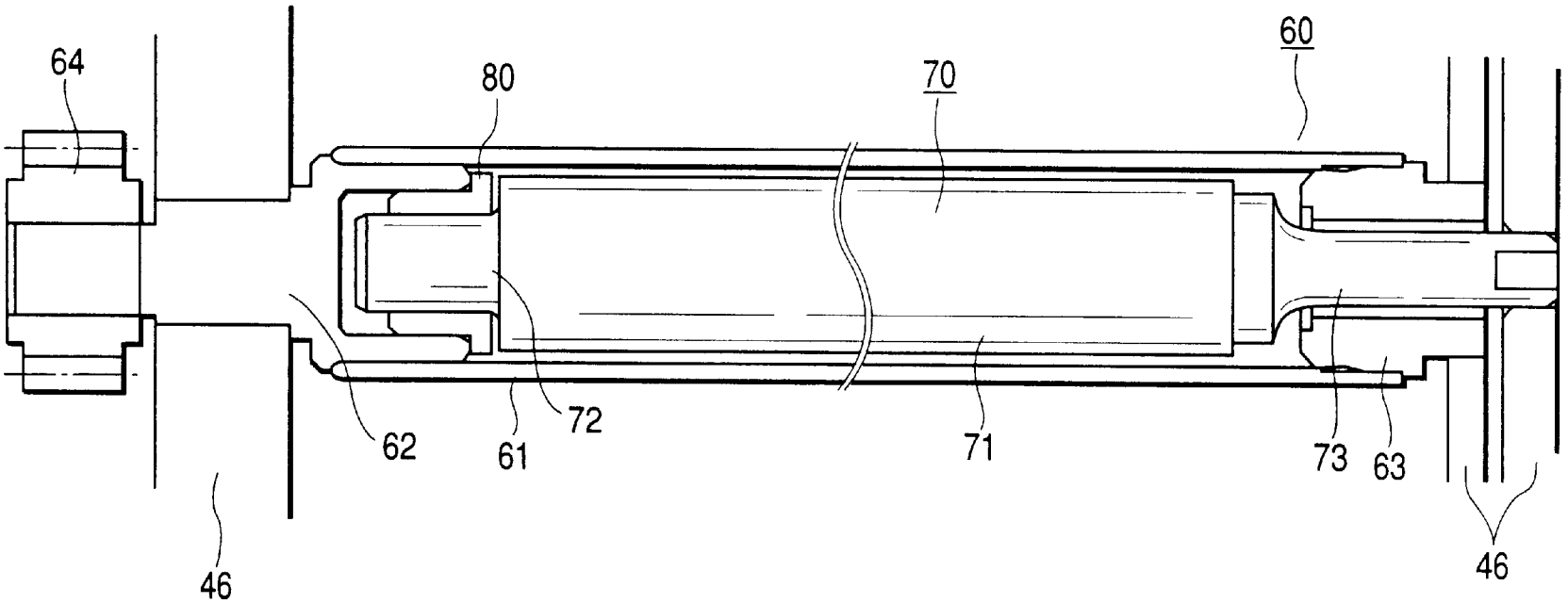
FIG. 3 is a sectional view showing a schematic construction of a developer carrying member according to an embodiment of the present invention in an axial direction.

Next, the developing apparatus 40 will be described with reference to FIGS. 2 and 3.

The developing apparatus 40 comprises a developing apparatus frame 46, a cylinder-shaped developer carrying member 61 and a developing blade 42 as a developer regulating member.

The interior of the developing apparatus frame 46 is divided into a toner chamber 45 and a developer supplying chamber 44, and the toner T as developer is contained in the toner chamber 45, and the developer carrying member 61 and the developing blade 42 are contained in the developer supplying chamber 44.

The developer carrying member 61 comprises a developing roller 60 as a hollow cylindrical member, a magnet roller 70 as a magnetic field generating member, and a magnet supporting member 80 as a bearing member.

The developing roller 60 comprises a cylinder portion 61 made of conductive and nonmagnetic material such as aluminum, and first and second flanges 62, 63 attached to both ends of the cylinder portion 61 and is rotatably held by the first and second flanges 62, 63.

The first flange 62 is made of aluminum, and a gear 64 as drive transmitting means is secured to a free end of the first flange.

An outer peripheral surface of the cylinder portion 61 of the developing roller 60 rotated in a direction shown by the arrow R2 during the operation of the image forming apparatus is opposed to the photosensitive drum 20 with a predetermined gap therebetween, and the developing blade 42 is urged against the outer peripheral surface of the cylinder portion 61 in a counter direction.

During the image formation, the toner T in the toner chamber 45 is carried from the toner chamber 45 to the developer supplying chamber 44 by its own weight or by conveying means (not shown) and is attracted to the vicinity of the developing roller 60 by a magnetic force of the magnet roller 70. On the other hand, the developing roller 60 is rotated in the direction R2 by the driving force transmitted through the gear 64.

The toner T attracted around the developing roller 60 is carried toward the developing blade 42 as the developing roller 60 is rotated, and regulation of a developer layer thickness and application of tribo-electricity are effected by the developing blade 42 while the toner is being carried toward the photosensitive drum 20.

Figure 4:
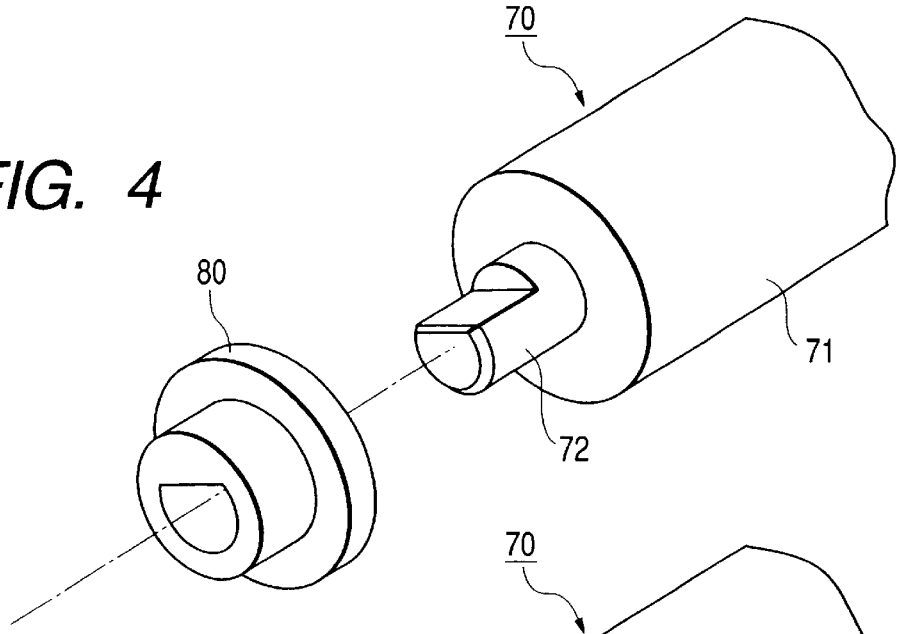
FIG. 4 is a perspective view showing schematic constructions of a hollow cylindrical member and a bearing portion provided on the developer carrying member according to the embodiment of the present invention.

Next, the developer carrying member 61, particularly, the magnet supporting member 80 according to the present invention will be fully described with reference to FIGS. 3 and 4.

The magnet roller 70 disposed within the developing roller 60 comprises a magnetizing portion 71, a first magnet shaft 72 integrally attached to one end of the magnetizing portion 71 and a second magnet shaft 73 integrally attached to the other end of the magnetizing portion 71.

The first magnet shaft 72 is held within the first flange 62 via the magnet supporting member 80, thereby permitting compactness of the developer carrying member.

The second magnet shaft 73 having a D-shaped free end passes through the second flange 63 and is fitted into a D-shaped hole formed in the developing apparatus frame 46 so that the magnet roller 70 is always held at a predetermined angle in a circumferential direction.

In the illustrated embodiment, D-shaped portions are formed on a free end of the first magnet shaft 72 of the magnet roller 70 and in an inner surface of the magnet supporting member 80 fitted on the first magnet shaft 72, thereby preventing relative rotation between the elements 72, 80. The magnet supporting member 80 fitted on the first magnet shaft 72 of the magnet roller 70 is fixed with respect to the circumferential direction due to the D-shaped connection between the elements 72, 80, so that, even when the developing roller 60 is rotated in the direction R2 during the image formation, the magnet supporting member 80 is not rotated but is merely slidingly contacted with the first flange.

Incidentally, in the illustrated embodiment, the magnet roller is made of resin based on nylon to have coefficient of linear expansion of about $3.0\times10^{-5}$/K, the magnet supporting member is made of polyphenylene sulfide to have coefficient of linear expansion of about $3.0\times10^{-5}$/K, and the first flange of the developing roller is made of aluminium to have coefficient of linear expansion of about $2.4\times10^{-5}$/K. Further, in the illustrated embodiment, a dimensional relationship between the first shaft portion of the magnet roller and the inner peripheral surface of the magnet supporting member is selected to "transition fit", and a dimensional relationship between the outer peripheral surface of the magnet supporting member and the inner peripheral surface of the first flange is selected to "clearance fit" to provide a gap of about 50 $\mu$m therebetween in consideration of difference in coefficient of linear expansion.

Thus, according to the illustrated embodiment, among the following factors for vibration of the magnet roller:

1) deviation in concentricity between the inner and outer diameters of the magnet supporting member, and
2) deviation in concentricity between the outer diameter of the developing roller and the inner diameter of the flange portion, the deviation in concentricity between the inner and outer diameters of the magnet supporting member is completely eliminated mechanically by the above-mentioned D-cut arrangement. In this way, by eliminating the vibration of the magnet roller, the developer carrying member can be made more compact and the uniformity of the image density can be further enhanced.

Figure 5:
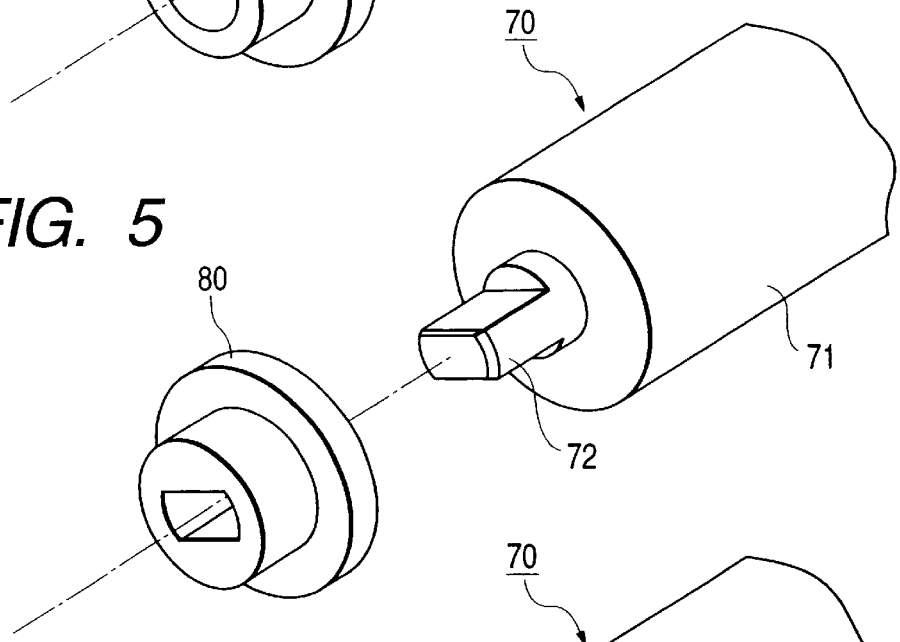
FIG. 5 is a perspective view showing schematic constructions of a hollow cylindrical member and a bearing portion provided on a developer carrying member according to another embodiment of the present invention.
Figure 6:
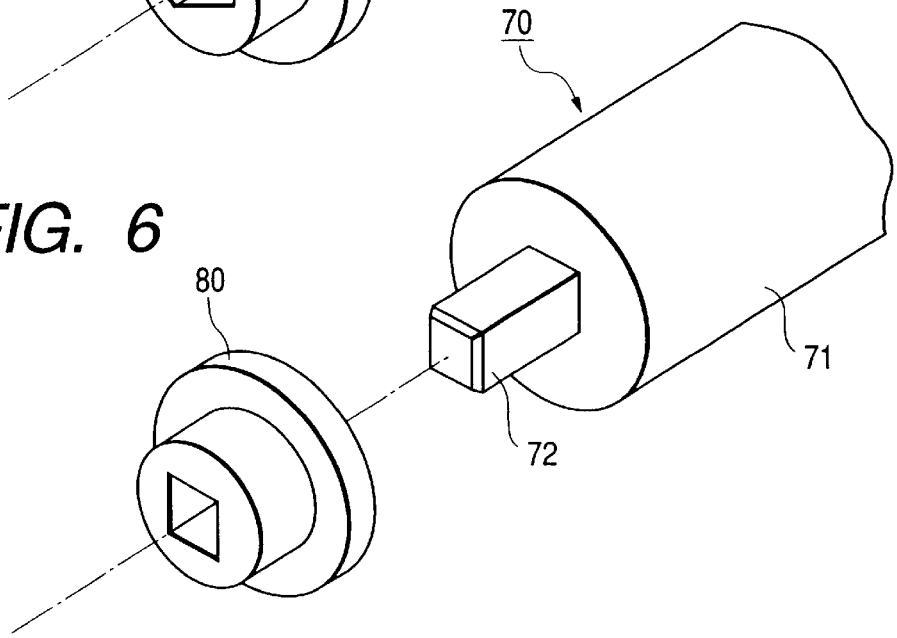
FIG. 6 is a perspective view showing schematic constructions of a hollow cylindrical member and a bearing portion provided on a developer carrying member according to a further embodiment of the present invention.
Figure 7:
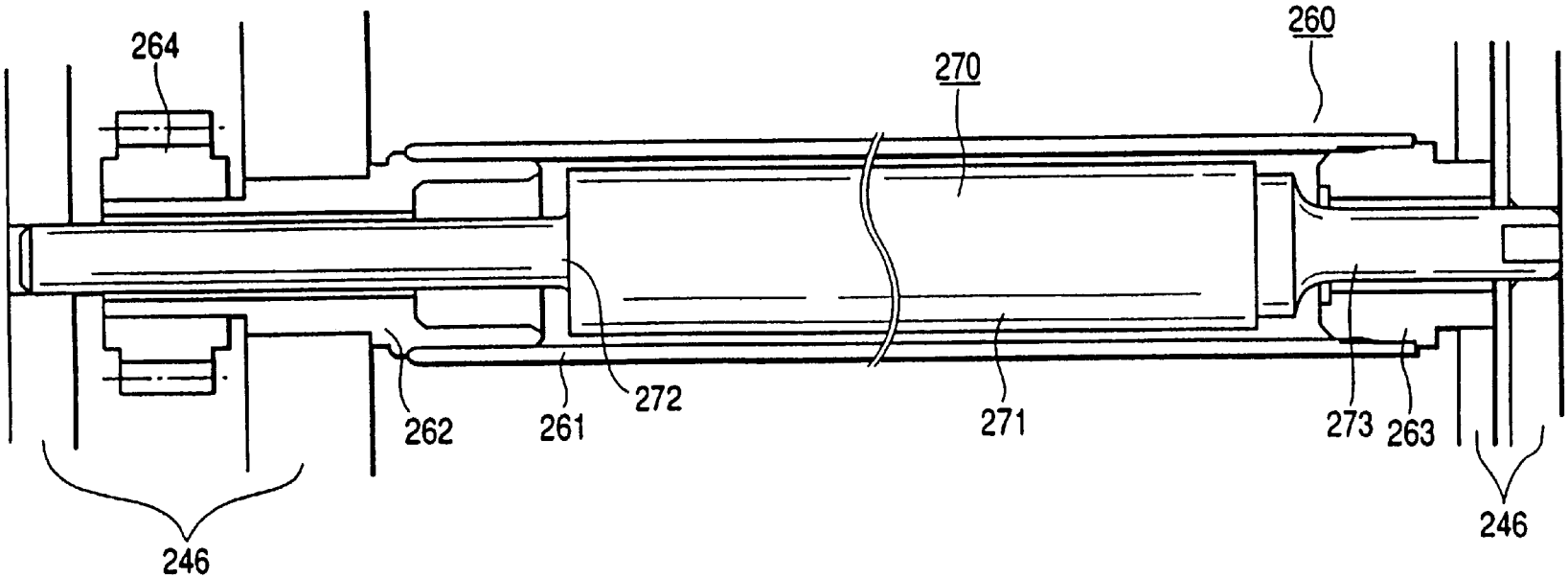
FIG. 7 PRIOR ART
FIG. 7 is a sectional view showing a schematic construction of a conventional developer carrying member in an axial direction.
Figure 8:
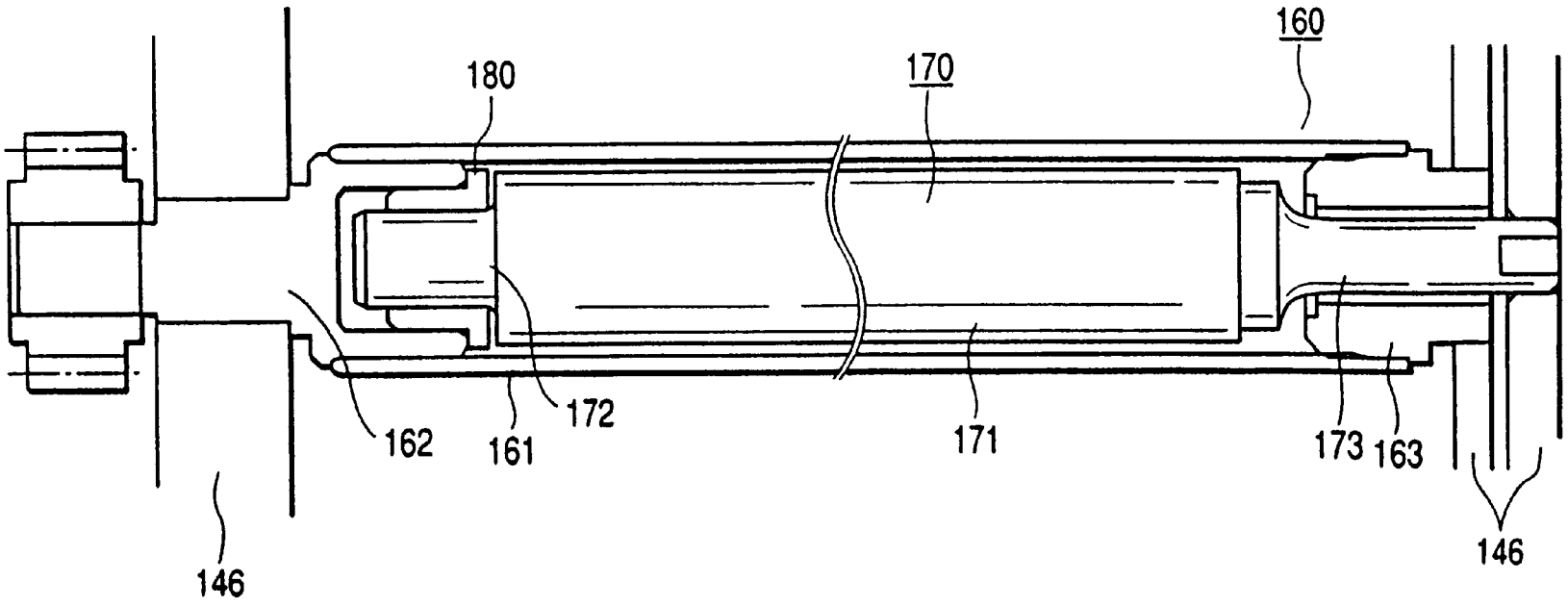
FIG. 8 PRIOR ART
FIG. 8 is a sectional view showing a schematic construction of a conventional developer carrying member in an axial direction.
Figure 9:
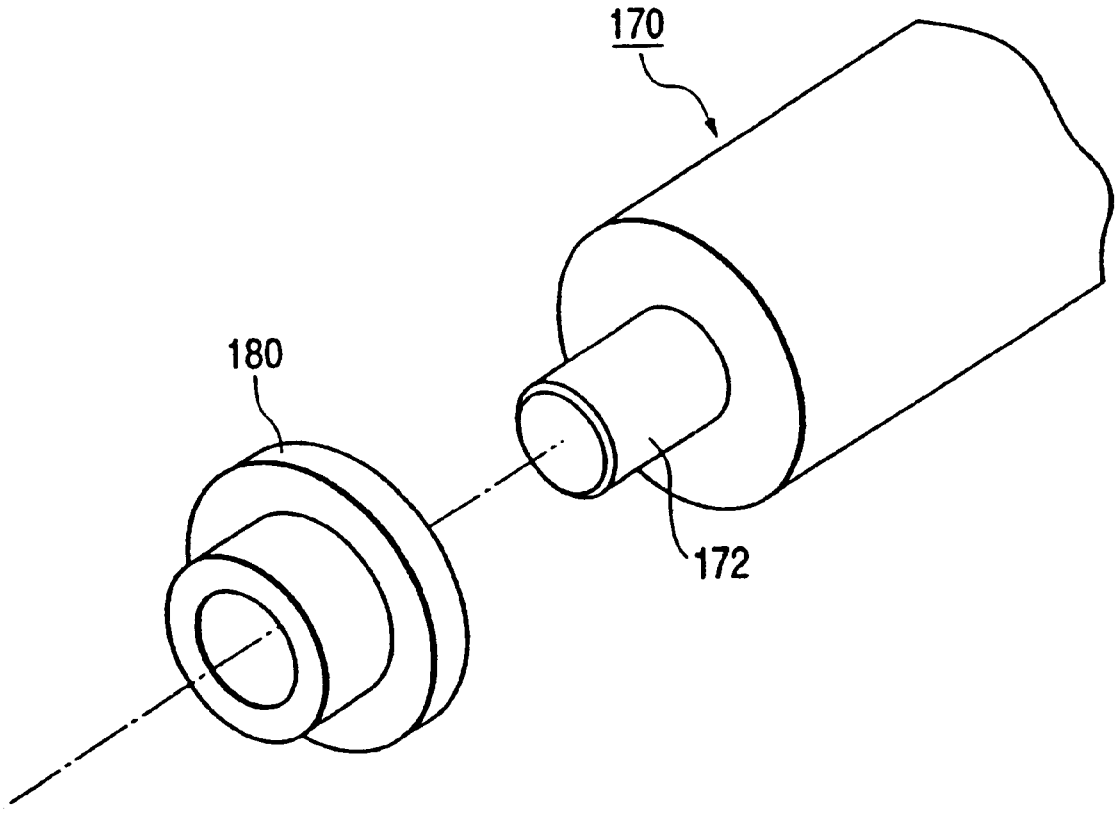
FIG. 9 PRIOR ART
FIG. 9 is a perspective view showing schematic constructions of a hollow cylindrical member and a bearing portion provided on the conventional developer carrying member.
Figure 10:
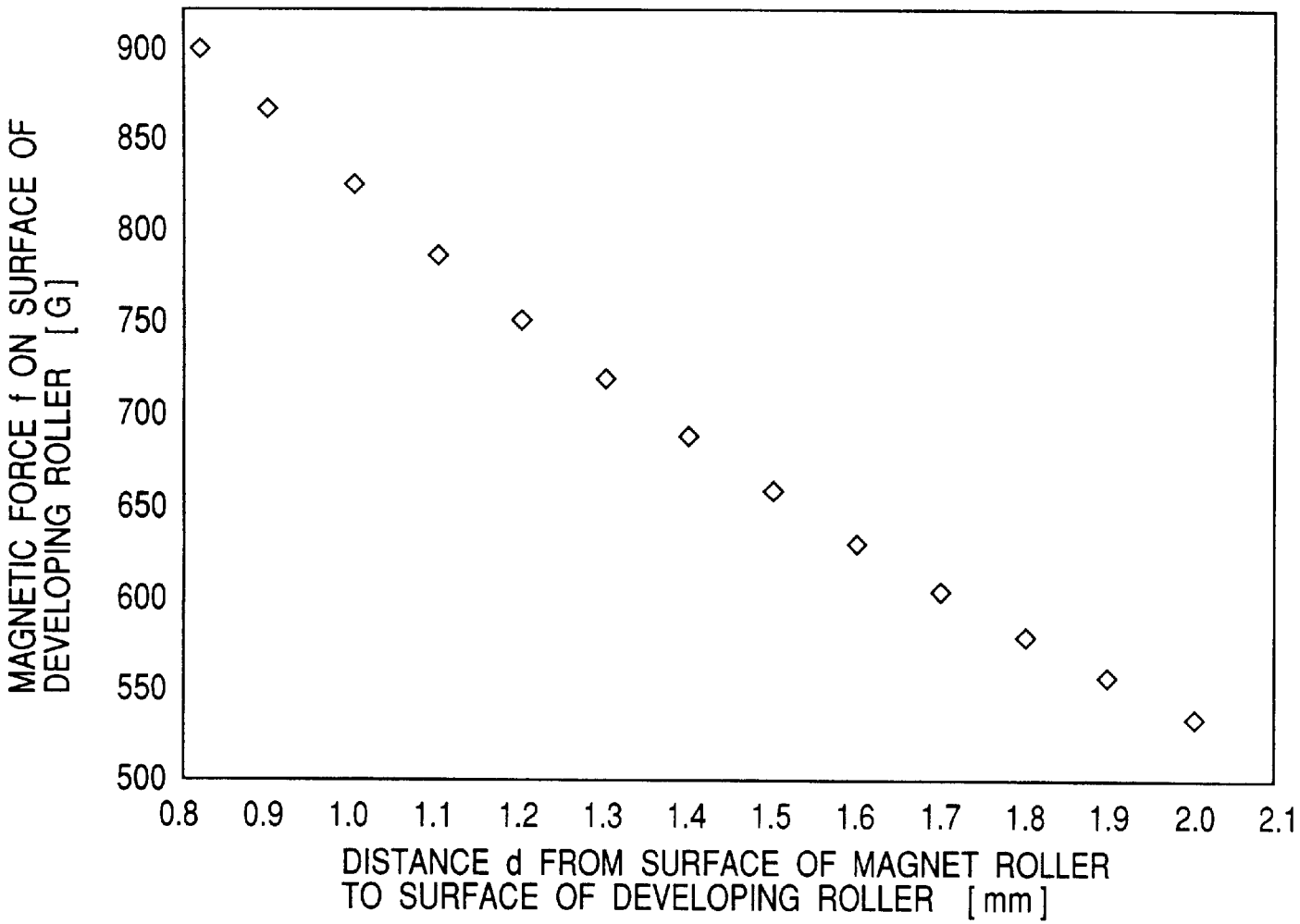
FIG. 10 is a graph showing a relationship between a distance from a surface of a magnetic field generating member to a surface of a hollow cylindrical member and magnetic force on the surface of the hollow cylindrical member.
Figure 11:
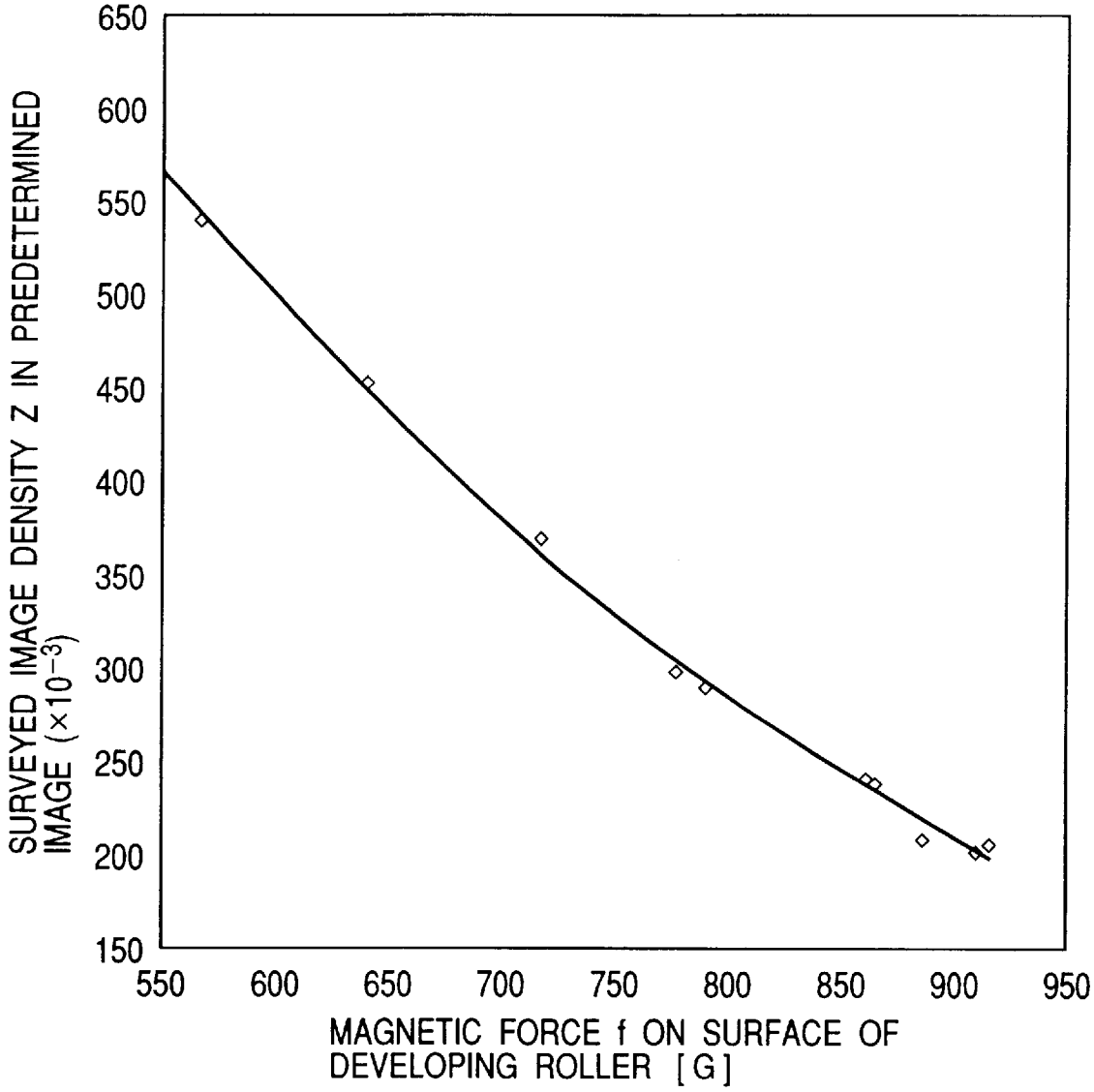
FIG. 11 is a graph showing a relationship between a magnetic force acting on the surface of the hollow cylindrical member and image density at predetermined print ratio.

Incidentally, in the illustrated embodiment, while an example that the D-shaped fitting between the magnet roller and the magnet supporting member is used in order to fix the circumferential positions of these elements was explained, the present invention is not limited to such an example. Since the above-mentioned circumferential fixing may be achieved, for example, the fitting portion between the magnet roller and the magnet supporting member may have a rectangular shape as shown in FIG. 5 or a square shape as shown in FIG. 6 so long as it has a noncircular shape.

Further, in the illustrated embodiment, while an example that the shaft portions are formed on the magnet roller and the holes into which the shaft portions can be fitted are formed in the magnet supporting member was explained, shaft portions may be formed on the magnet supporting member and holes into which the shaft portions can be fitted may be formed in the magnet roller.

While the present invention is explained with reference to the embodiments thereof, the present invention is not limited to such embodiments, and various alterations and modifications can be made within the scope of the invention.

What is claimed is:

1. A developing apparatus comprising:

a developer carrying member opposed to an image bearing member for bearing a latent image and adapted to carry magnetic developer;

a magnet provided within said developer carrying member, wherein one end of said magnet is secured to a frame of said apparatus and the other end of said magnet is supported by said developer carrying member, and, wherein said magnet is not rotatable relative to said frame of said apparatus; and a bearing provided between the other end of said magnet and said developer carrying member;

wherein a fitting portion between the other end of said magnet and said bearing has a noncircular shape so that said bearing cannot be rotated.

2. A developing apparatus according to claim 1, wherein said fitting portion has a D-shape.

3. A developing apparatus according to claim 1, wherein the fitting portion has a polygonal shape.

4. A developing apparatus according to claim 1, wherein the developing apparatus is a process cartridge which is a unit integrated with said image bearing member and detachably attachable to an image forming apparatus.

* * * * *

UNITED STATES PATENT AND TRADEMARK OFFICE

CERTIFICATE OF CORRECTION

PATENT NO. : 6,522,854 B2
DATED : February 18, 2003
INVENTOR(S) : Tsutomu Nishiuwatoko It is certified that error appears in the above-identified patent and that said Letters Patent is hereby corrected as shown below:

Column 1,
Line 11, "image an" should read -- image on --.

Column 2,
Line 18, "extend" should read -- extended --.

Column 3,
Line 20, "aluminium." should read -- aluminum. --; and
Line 62, "at" should read -- at a --.

Column 4,
Line 21, "on" should read -- on the --;
Line 39, "direction." should read -- direction; --.

Column 5,
Line 3, "at" should read -- at a --.

Column 7,
Line 31, "aluminium" should read -- aluminum --;
Line 46, "member," should read -- member; --; and
Line 52, "D-cut" should read -- D-shaped --.

Column 8,
Line 46, "the" should read -- said --; and
Line 48, "the" should read -- said -- and "cartridge" should read -- cartridge, --.

Signed and Sealed this

Sixteenth Day of September, 2003

JAMES E. ROGAN
*Director of the United States Patent and Trademark Office*